United States Patent [19]

Chamberlain

[11] Patent Number: 4,993,988

[45] Date of Patent: Feb. 19, 1991

[54] TOY FIGURE WITH CLIP-ON HAIR PIECE

[75] Inventor: Michael K. Chamberlain, Manhattan Beach, Calif.

[73] Assignee: Mattel, Inc., Hawthorne, Calif.

[21] Appl. No.: 498,667

[22] Filed: Mar. 26, 1990

[51] Int. Cl.[5] ..... A63H 3/44

[52] U.S. Cl. ..... 446/394; 446/319

[58] Field of Search ..... 446/394, 319, 268, 391, 446/387, 388, 98, 100; 132/53, 54

[56] References Cited

U.S. PATENT DOCUMENTS

| | | | |
|---|---|---|---|
| 1,714,358 | 5/1929 | Finkelstein . | |
| 2,165,716 | 7/1939 | Molleson | 132/54 |
| 2,323,522 | 7/1943 | Journette | 446/387 |
| 2,620,809 | 12/1952 | Rosen | 132/53 |
| 2,651,310 | 9/1953 | Selson | 132/54 |
| 3,156,999 | 11/1964 | Dean et al. | 446/319 |
| 3,225,489 | 12/1965 | Ryan | 446/394 |
| 3,808,736 | 5/1974 | Terzian et al. | 446/319 |
| 4,070,790 | 1/1978 | Strongin et al. | 446/394 |
| 4,414,774 | 11/1983 | Fogarty et al. | 446/98 |
| 4,830,029 | 5/1989 | Bird | 132/54 |

*Primary Examiner*—Mickey Yu

*Attorney, Agent, or Firm*—Roy A. Ekstrand

[57] ABSTRACT

A toy figure includes a molded plastic head having defined therein a simulated hair bow. The hair bow defines a generally barrel-shaped center portion. A clip-on hair piece includes a generally U-shaped resilient clip adapted to be received upon the barrel-shaped center portion of the simulated bow in a resilient snap-fit attachment. A quantity of simulated or artificial hair is secured to the resilient clip to form a ponytail-like plume of hair. The clip-on hair piece is particularly adapted to be easily used by small children.

6 Claims, 1 Drawing Sheet

TOY FIGURE WITH CLIP-ON HAIR PIECE

FIELD OF THE INVENTION

This invention relates generally to toy figures and dolls and particularly to those having removable hair pieces or wigs.

BACKGROUND OF THE INVENTION

Through the years, many dolls and toy figures have been created which include simulated or artificial hair as part of the doll character and makeup. In many instances, the intended play value of such simulated artificial hair includes the ability of the child user to manipulate and style the simulated hair. To further enhance this aspect of the doll or toy figure and to add variety and flexibility to such dolls and toy figures, many have been provided with interchangeable or removable wigs, hair pieces and other attachments such as tiaras and the like. While such removable wigs, hair pieces, etc. are helpful in increasing the play value and amusement value of the doll or toy's figures, there remains nonetheless a continuing need for improvement of such doll and toy figures. Thus, to meet this need, practitioners in the art have provided a variety of such devices. For example, U.S. Pat No. 4,070,790 issued to Strongin sets forth a DOLL WITH RELEASABLY ATTACHED HAIR PIECES in which a doll is provided with a doll head having a plurality of recessed grooves arranged therein. The grooves further define locking apertures within the recessed grooves. A plurality of hair pieces and hair appliances are configured to be received within and locked to the recessed grooved portions of the doll head.

U.S. Pat. No. 1,714,358 issued to Finkelstein sets forth a HAIR PIECE AND ATTACHING COMB THEREFOR in which a conventional hair piece is fitted with a comb-like attaching element having a plurality of straight tines and an interleaved plurality of multiply curved tines. The curved and straight tines cooperate to secure the comb and thereby the hair piece to the wearer's hair in a removable attachment.

U.S. Pat. No. 2,620,809 issued to Rosen sets forth a HAIR PIECE AND CLIP in which a simulated hair piece includes a front border portion which supports a plurality of attaching clips each configured to be received within and locked to a small portion of the wearer's hair.

U.S. Pat. No. 8,808,736 issued to Terzian, et al. sets forth a HAIR STYLING FIGURE AND ACCESSORIES in which a hair styling figure includes a doll-like head having a center passage therethrough. A hair piece is adapted to be received within the center passage and thereby provide an attachment between the hair piece and the hairstyling figure or doll.

U.S. Pat. No. 4,830,029 issued to Bird sets forth a METHOD OF AND APPARATUS FOR STYLING HAIR in which a wire member formed into a loop includes end portions secured to an end portion of a tape. The tape carries a weave of false hair and attachment is accomplished by inserting selected strands of hair on the to-be-styled user and thereafter rotating the apparatus to secure the hair strands within the wire loop.

U.S. Pat. No. 2,165,716 issued to Molleson sets forth a HAIRDRESSING APPLIANCE in which a plurality of artificial hair strands are secured to an elongated member having a clasp attachment for use in securing the hair piece to the wearer's hair.

U.S. Pat. No. 2,651,310 issued to Sellson sets forth a HEAD CONFORMING MOUNTING FOR ADJUSTABLY POSITIONABLE HAIR PIECES in which a plurality of flexible hair attachment mechanisms are shown for use in securing hair pieces to the wearer's hair.

While the foregoing described devices may be utilized to secure hair pieces to a doll or toy figure and provide some flexibility and entertainment value enhancement, such devices are difficult and intricate to use in many instances or form relatively unreliable attachments which will not withstand the play activities of a small child. Furthermore, the above-described prior art attachment means are often too intricate or difficult for a young child to utilize. There remains, therefore, a need in the art for a simple, effective and inexpensive hair attachment mechanism for use with dolls and toy figures. There remains a further need in the art for an improved attachable hair piece mechanism which may be readily manipulated by young children.

SUMMARY OF THE INVENTION

Accordingly, it is a general object of the present invention to provide an improved toy figure with clip-on hair piece. It is a more particular object of the present invention to provide an improved toy figure with clip-on hair piece which securely and reliably attaches to the toy figure. It is a still more particular object of the present invention to provide an improved toy figure with clip-on hair piece which is suitable for use by young children having limited hand skills.

In accordance with the present invention, there is provided a toy figure comprises: a toy figure body having arms, legs and torso; a head defining a headpiece decoration, the decoration defining a first cooperating attachment portion; a resilient clip defining a locking channel sized and shaped to be snap-fitted to the first cooperating attachment portion; and a quantity of simulated hair strands secured to the resilient clip, the resilient clip being removably attached to and removed from the headpiece decoration by a snap-fit engagement with the first cooperating attachment portion.

BRIEF DESCRIPTION OF THE DRAWINGS

The features of the present invention, which are believed to be novel, are set forth with particularity in the appended claims. The invention, together with further objects and advantages thereof may best be understood by reference to the following description taken in conjunction with the accompanying drawings, in the several figures of which like reference numerals identify like elements and in which:

DESCRIPTION OF THE PREFERRED EMBODIMENT

Figure 1:
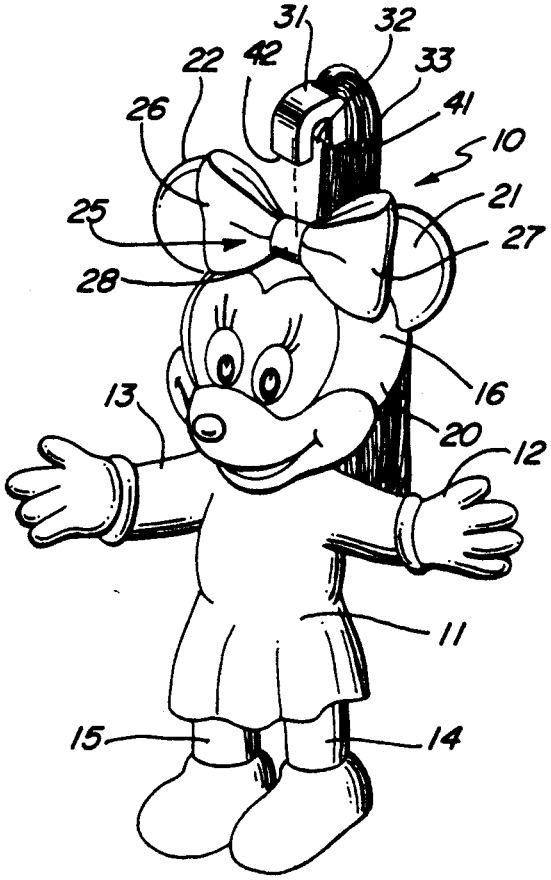
FIG. 1 sets forth a front assembly view of a toy figure with clip-on hair piece constructed in accordance with the present invention.

FIG. 1 sets forth a toy figure constructed in accordance with the present invention and generally referenced by numeral 10. Toy figure 10 includes a torso 11, a pair of outwardly extending arms 12 and 13, and a pair of legs 14 and 15. Toy figure 10 further includes an animated head 16 styled to provide a fanciful replication of a cartoon-like female mouse. Accordingly, head 16 defines a pair of ears 21 and 22 and a hair bow 25 having outwardly extending loop portions 26 and 27 joined by a generally barrel-shaped center portion 28. While toy figure 10 may be fabricated using any number of manufacturing techniques, in its preferred form head 16 of toy figure 10 is formed of a single one piece molded plastic member in which head 16, ears 21 and 22, and hair bow 25 are integrally formed. A removable clip-on hair piece 30 includes a generally U-shaped resilient clip member 31 having an internal locking channel 32 defined therein and a bundle of simulated or artificial hair extending from clip 31. In its preferred form, hair 33 is molded or otherwise bonded to resilient clip 31 at one end and is free flowing therefrom at the other end to form a ponytail-like hair piece.

In the position shown in FIG. 1, hair piece 30 is disassembled or separated from toy figure 10. In accordance with the invention, hair piece 30 may be removably assembled to toy figure 10 by aligning locking channel 32 of resilient clip 31 with center portion 28 of hair bow 25 such that hair 3 extends downwardly to the rear of head 16. With such alignment accomplished, resilient clip 31 is force downwardly upon center portion 28 of hair bow 25 such that center portion 28 is received within locking channel 32. As mentioned, center portion 28 defines a generally barrel-like structure. Accordingly and in accordance with an important aspect of the present invention, resilient clip 31 is formed of a suitably resilient material to provide a spring closure force between end portions 41 and 42 upon center portion 28 as clip 31 is forced downwardly upon center portion 28. In further accordance with the present invention, locking channel 32 is configured and sized to receive center portion 28 in an interference or snap-fit. Thus, resilient clip 31 of hair piece 30 is forced upon center portion 28 in a snap-fit attachment which may be readily accomplished by young children.

Hair piece 30 is removed from toy figure 10 by simply pulling hair 33 away from toy figure 10 with sufficient force to overcome the resilient clasping action of clip 31 upon center portion 28. Thus, hair piece 30 is readily separable and removable from toy figure 10. Because the resilient clasp action of clip 31 is provided by the resilience of the material itself, hair piece 30 is extremely simple and its clasping mechanism is extremely reliable. Thus, it is anticipated that hair piece 30 will enjoy a long period of use even under the roughest handling circumstances.

Figure 2:
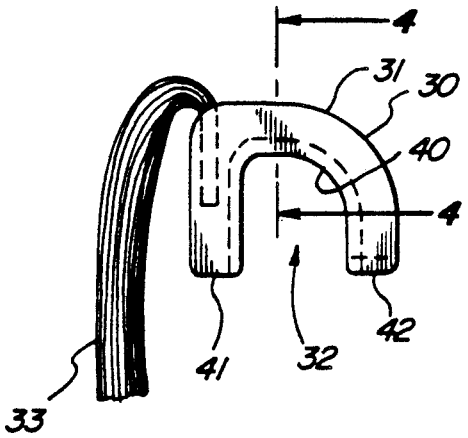
FIG. 2 sets forth a side view of the present invention clip-on hair piece.

FIG. 2 sets forth a side view of hair piece 30. Hair piece 30 includes a generally U-shaped resilient clip 31 formed of a resilient plastic material or the like and having end portions 41 and 42. In accordance with an important aspect of the present invention, resilient clip 31 defines a generally U-shaped locking channel 32 between end portions 41 and 42 which in turn defines a concave surface 40 configured to conform the contour of center portion 28 of hair bow 25 (seen in FIG. 1). While hair 33 may be attached to resilient clip 31 using any number of attachment mechanisms, it has been found economically advantageous to mold hair 33 directly into resilient clip 31 to provide a secure attachment as shown in FIG. 2. Alternatively, a well or passage may be molded into resilient clip 31 and the end portions of hair 33 inserted therein together with an appropriate adhesive. In either event, the structure formed by hair piece 30 provides a durable and easy to manipulate hair piece attachment mechanism for use by small children.

Figure 3:
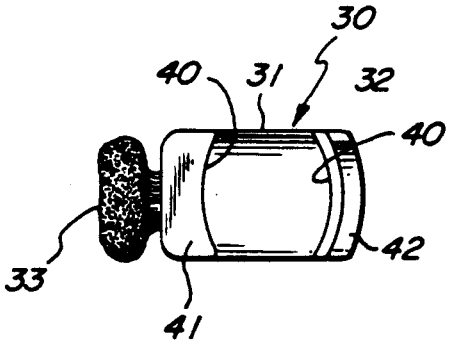
FIG. 3 sets forth a bottom view of the clip-on hair piece of the present invention.

FIG. 3 sets forth a bottom view of hair piece 30 showing resilient clip 31 and hair 33 attached thereto. As described above, resilient clip 31 defines an internal blocking channel 32 and a pair of end portions 41 and 42. As is further described above, locking channel 32 defines an internal concave surface 40 configured to conform to the surface of center portion 28 of hair bow 25 (seen in FIG. 1).

Figure 4:
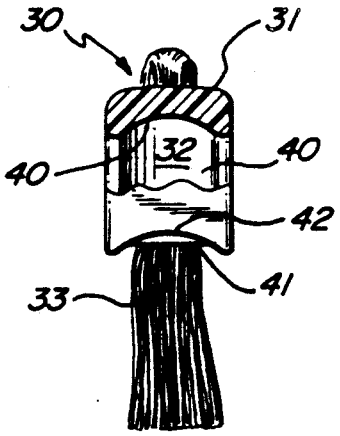
FIG. 4 sets forth a partially sectioned view of the present invention clip-on hair piece.

FIG. 4 sets forth a partially sectioned front view of hair piece 30. Accordingly, hair piece 30 includes a resilient clip 31 formed of a molded plastic material and defining a generally concave internal surface 40 and supporting a quantity of artificial or simulated hair 33. With temporary reference to FIG. 1, it should be noted that head 16 describes a generally convex curved surface adjacent center portion 28 of hair bow 25. With reference now to FIG. 4, a corresponding concave curvature is defined in end portion 41 of resilient clip 31 to permit resilient clip 31 to be firmly and fully seated upon center portion 28 of hair bow 25.

What has been shown is a simple, economically manufacturable and easy to use toy figure with clip-on hair piece suitable for use by small children. The hair piece is readily attachable and removable from the toy figure through a simple resilient snap-fit attachment.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A toy figure comprising:

a toy figure body having arms, legs and torso;

a head defining a headpiece decoration including a bow and a first cooperating attachment portion defining a center portion thereof a resilient clip defining a locking channel sized and shaped to be snap-fitted to said first cooperating attachment portion; and a quantity of simulated hair strands secured to said resilient clip, said resilient clip being removably attached to and removed from said headpiece decoration by a snap-fit engagement with said first cooperating attachment portion.

2. A toy figure as set forth in claim 1 wherein said center portion is generally barrel-shaped and wherein said locking channel defines a corresponding concave surface.

3. A toy figure as set forth in claim 2 wherein said resilient clip is formed of a generally U-shaped molded plastic member.

4. A toy figure as set forth in claim 3 wherein said resilient clip defines first and second end portions and wherein said first end portion defines a concave surface.

5. A toy figure comprising:

a toy figure body having arm, leg and torso portions;

a head formed of a molded plastic material having a simulated hair bow thereon, said hair bow defining a generally cylindrical center portion and a pair of outwardly extending loop portions joined thereto;

a generally U-shaped clip member formed of a resilient material and having a locking channel defined therein, said locking channel sized and shaped to provide a snap-fit attachment between said clip and said center portion of said hair bow; and a plurality of simulated hair strands joined to said clip.

6. A toy figure as set forth in claim 5 wherein said center portion defines a barrel-shaped convex surface and wherein said locking channel defines a correspondingly curved concave surface.

* * * * *